US006378833B1

(12) United States Patent
Ries

(10) Patent No.: US 6,378,833 B1
(45) Date of Patent: Apr. 30, 2002

(54) OUT-BOARD MOTOR ROTATING BRACKET MOUNT FOR TRANSOM PLATFORM STERNDRIVE BOATS

(76) Inventor: Vincent F. Ries, 50 Countryside Dr., Doylestown, PA (US) 18901

( * ) Notice: Subject to any disclaimer, the term of this patent is extended or adjusted under 35 U.S.C. 154(b) by 0 days.

(21) Appl. No.: 09/550,119

(22) Filed: Apr. 17, 2000

Related U.S. Application Data

(60) Provisional application No. 60/133,698, filed on May 12, 1999.

(51) Int. Cl.[7] ..... F16M 3/00

(52) U.S. Cl. ..... 248/640; 440/53

(58) Field of Search ..... 248/640, 637, 248/641, 642, 643; 440/53, 55, 57, 63, 64, 65

(56) References Cited

U.S. PATENT DOCUMENTS

| | | | | | |
|---|---|---|---|---|---|
| 1,523,909 | A | * | 1/1925 | Shryock | 248/642 |
| 2,901,267 | A | * | 8/1959 | Holsclaw | 248/642 |
| 3,724,790 | A | * | 4/1973 | Harris et al. | 248/642 |
| 4,129,088 | A | * | 12/1978 | Foley, Jr. | 248/642 |
| 4,410,161 | A | * | 10/1983 | Booty | 248/642 |
| 4,634,390 | A | * | 1/1987 | Baird | 248/642 |
| 4,875,656 | A | * | 10/1989 | Boede | 248/642 |
| 6,224,437 | B1 | * | 5/2001 | Griffith, Sr. et al. | 440/53 |

FOREIGN PATENT DOCUMENTS

| | | | | |
|---|---|---|---|---|
| GB | 2032372 | * | 5/1980 | 248/642 X |

* cited by examiner

*Primary Examiner*—Ramon O. Ramirez

(57) ABSTRACT

The need for transom platform sterndrive configured boats to have a backup power source in an emergency situation has been the driver in this invention. Using this invention, the rotating bracket mount, enables a motor to be mounted on the bracket mount or both removed for on board storage from inside transom platform sterndrive configured boats.

2 Claims, 9 Drawing Sheets

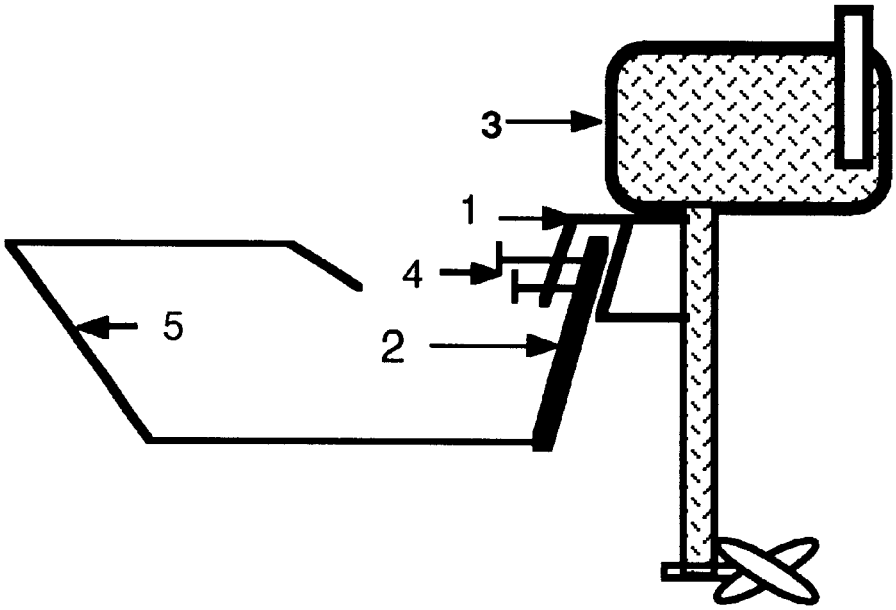
FIG. 1.0 Prior Art
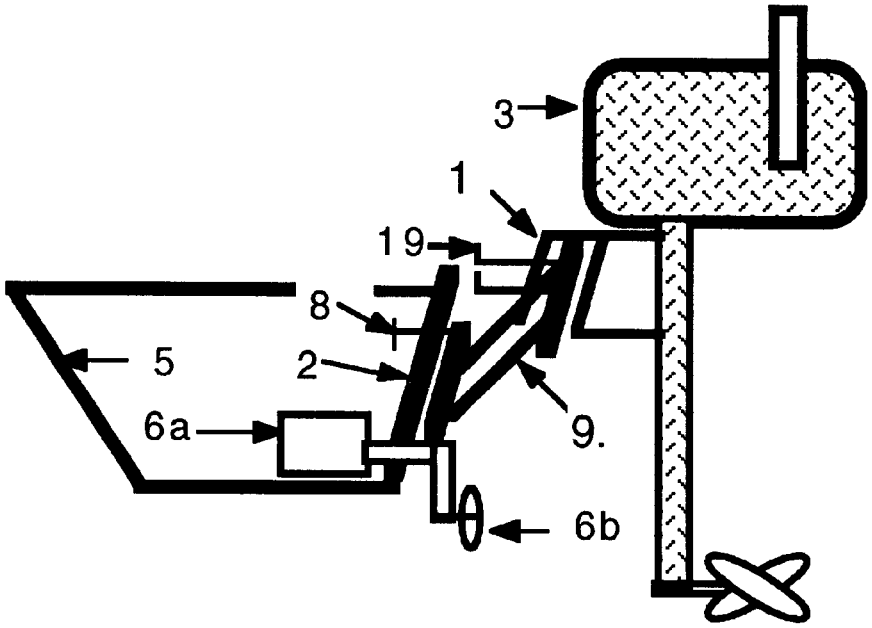
FIG. 1.1 Prior Art

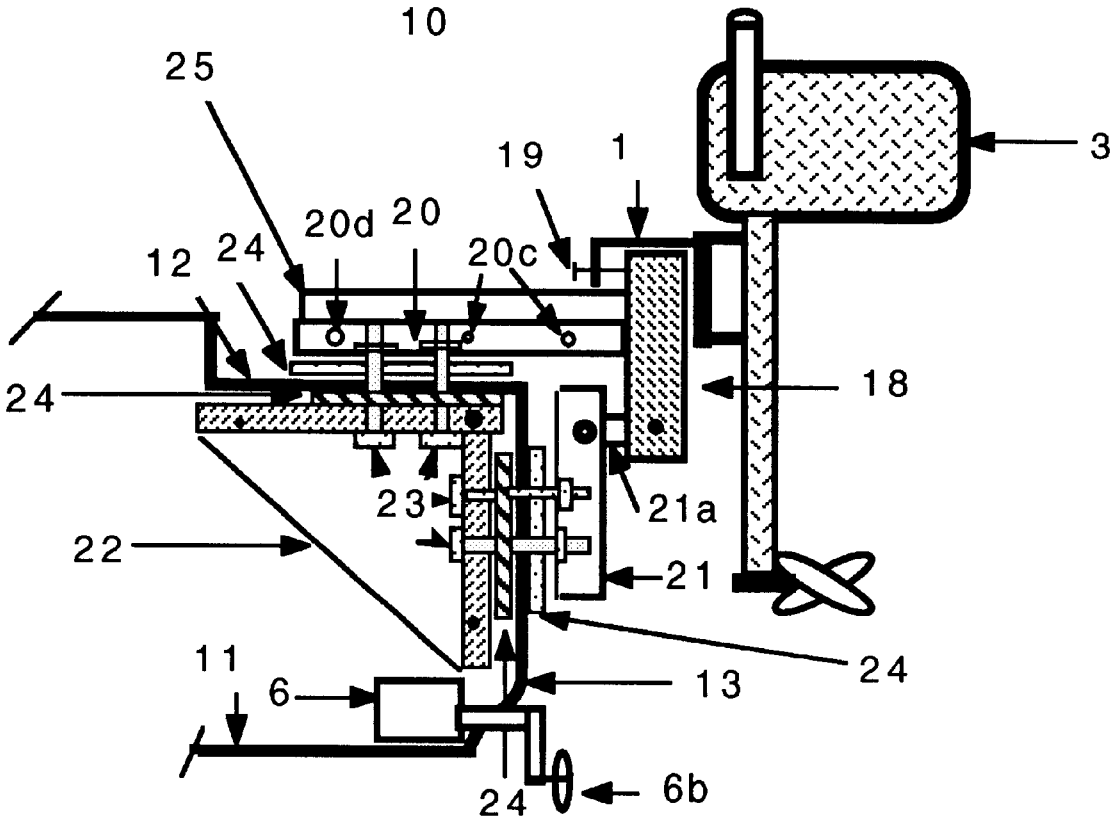
FIG. 2.0

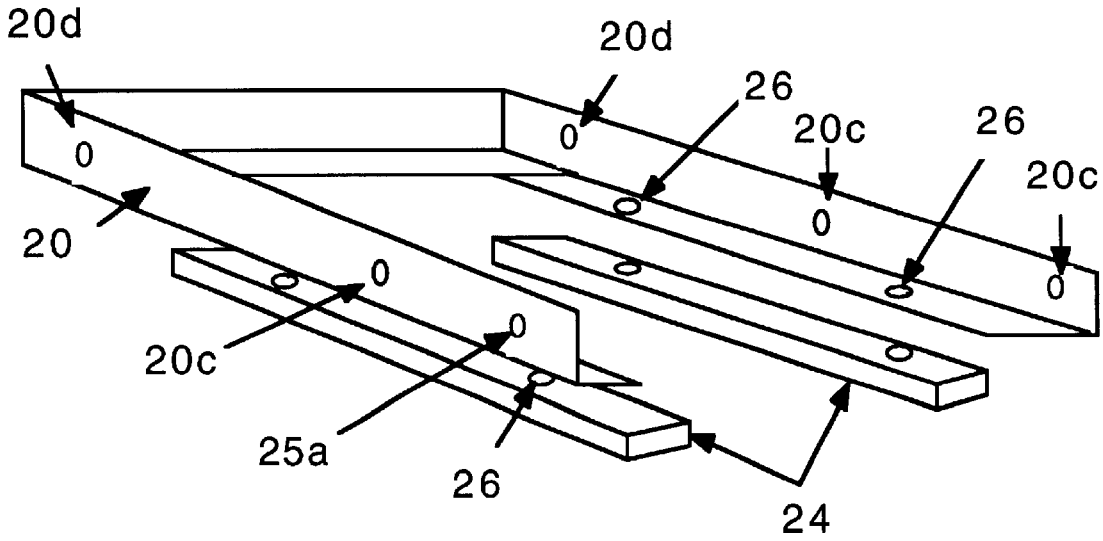
FIG. 3.0

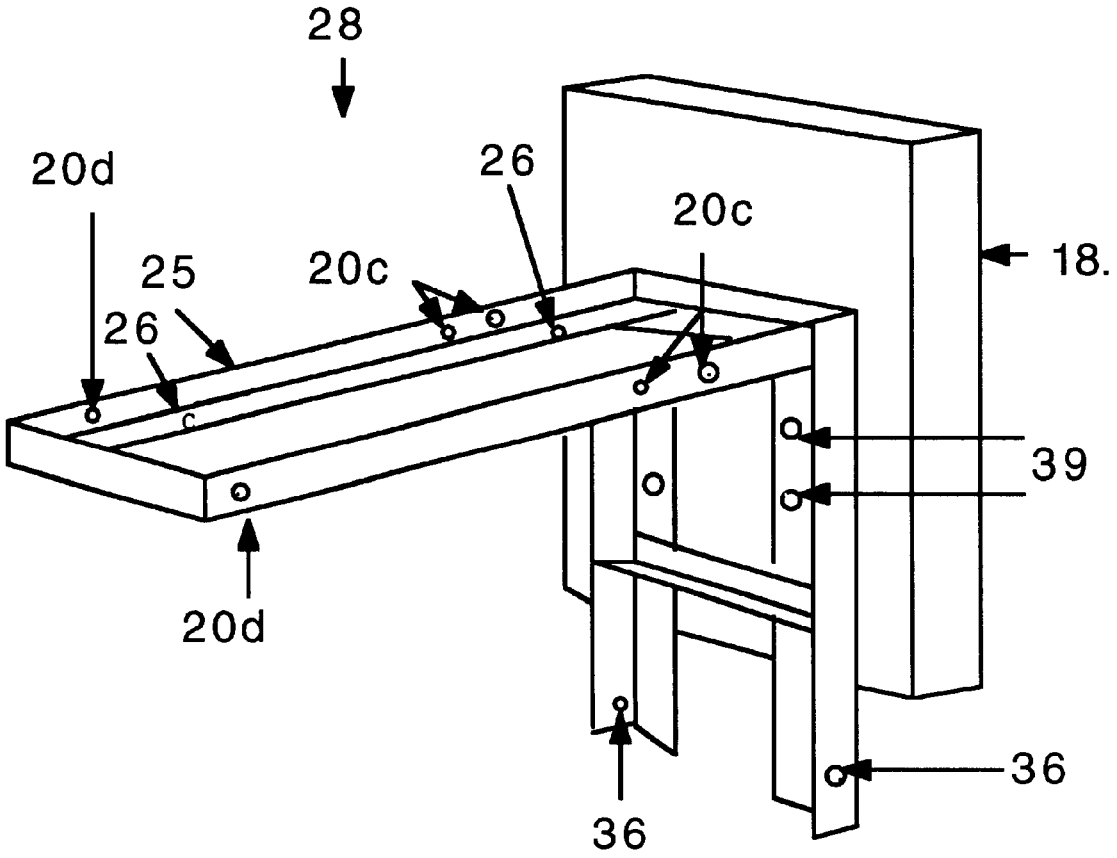
FIG. 3.1

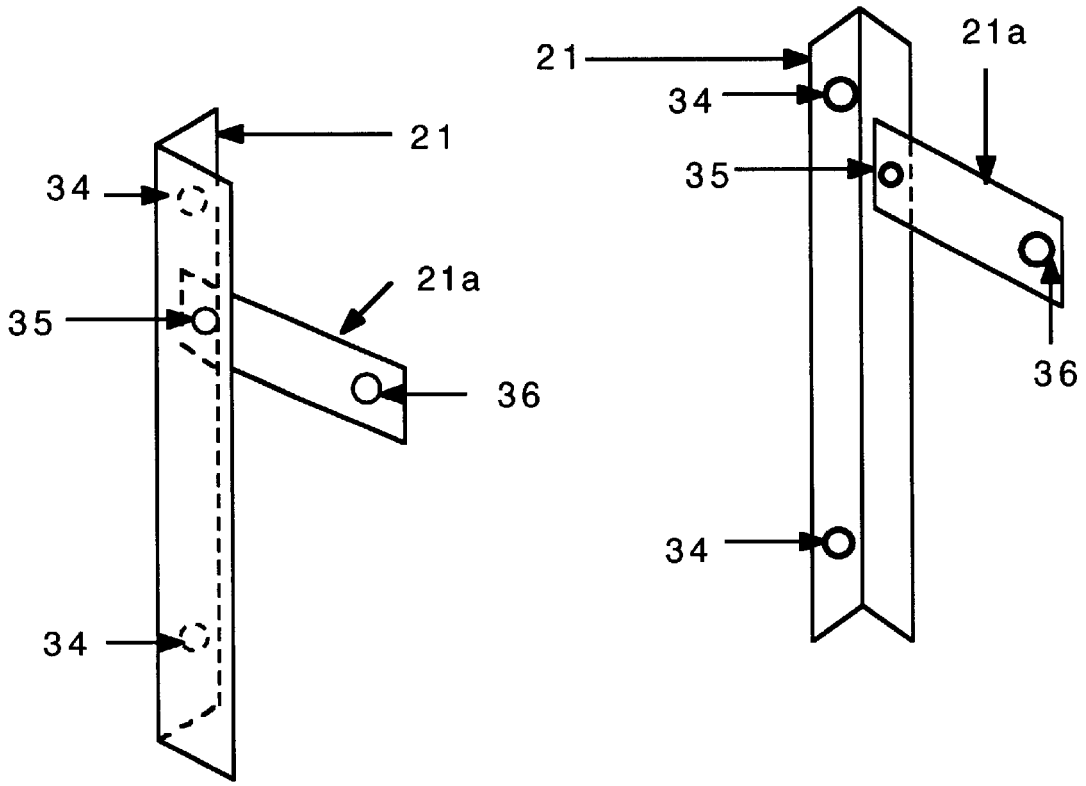
FIG. 3.2

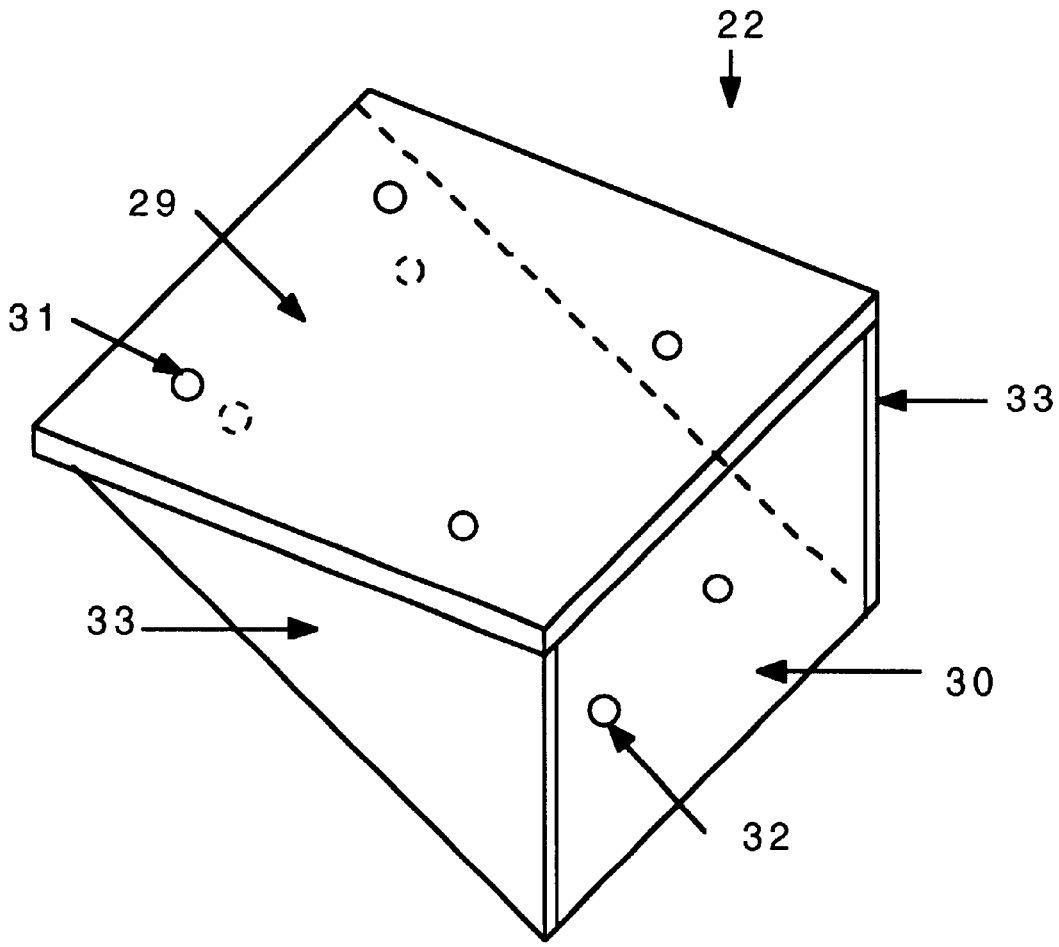
FIG. 3.3

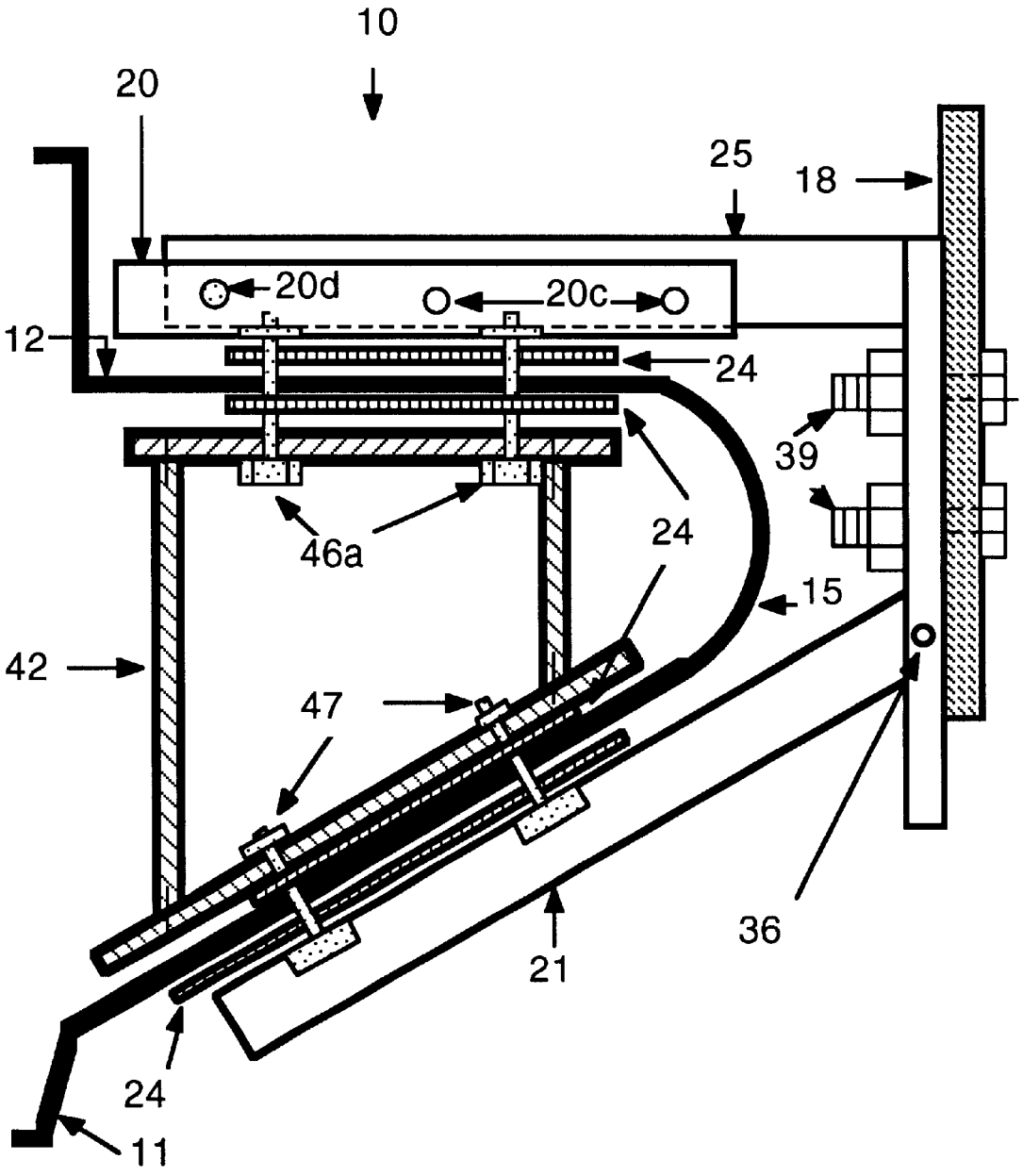
FIG. 4.0

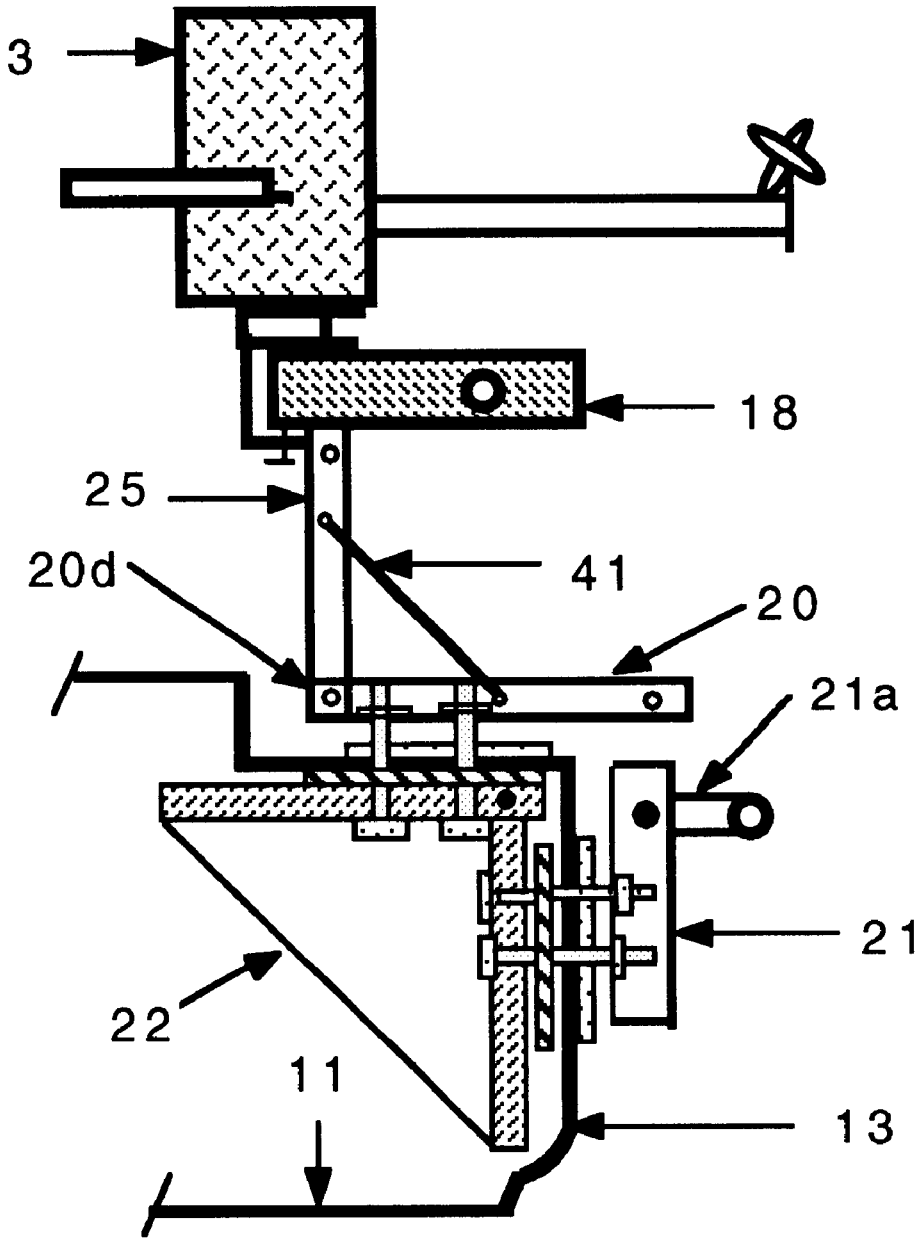
FIG. 5.0

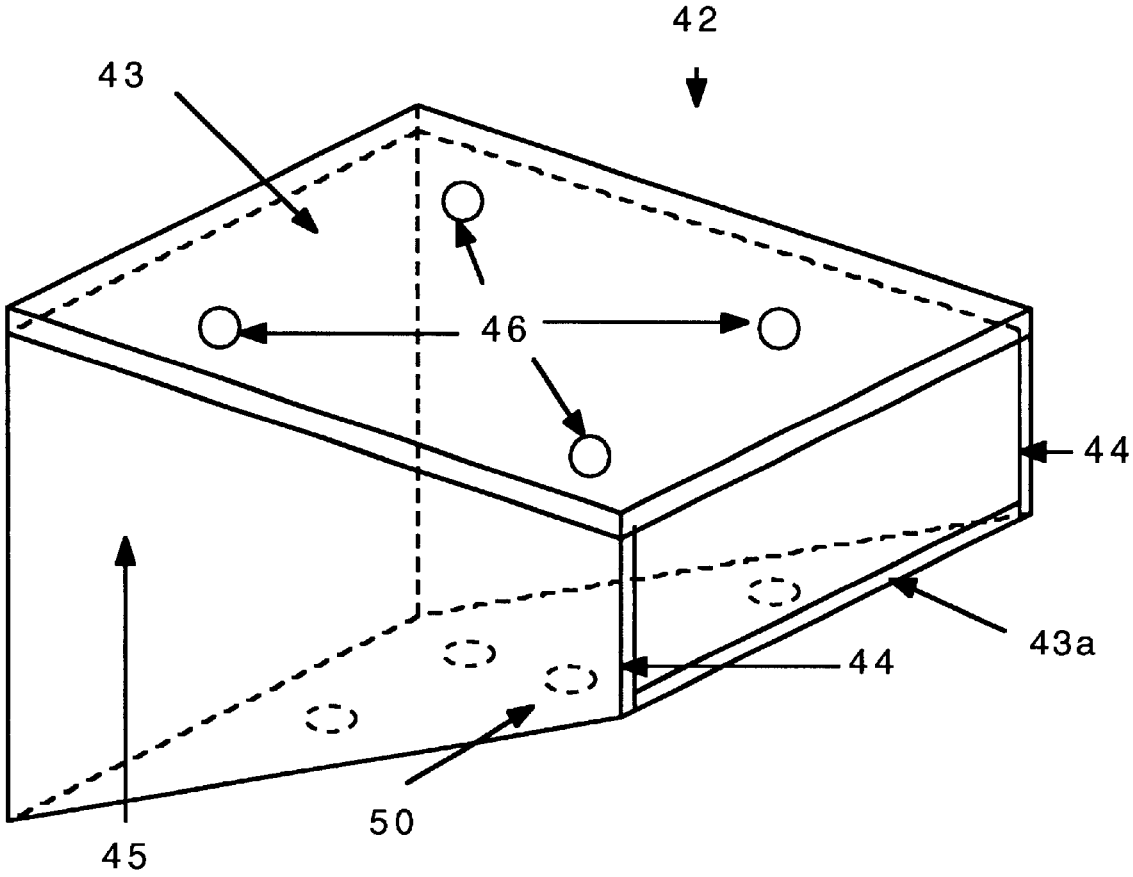
FIG. 6.0

OUT-BOARD MOTOR ROTATING BRACKET MOUNT FOR TRANSOM PLATFORM STERNDRIVE BOATS

RELATED APPLICATION

This application claims the benefit of Provisional Application No. 60/133,698 filed May 12, 1999.

FIELD OF INVENTION

This invention is a motor bracket for sterndrive boats with a transom platform. The rotating bracket mount provides for a safe on-board mounting of both the bracket and motor in an emergency.

BACKGROUND OF THE INVENTION

The three most widely used configurations for primary propulsion in boating are outboards mounted on a flatback transom, a sterndrive mounted through a flatback transom, or a sterndrive mounted through a transom and underneath a transom platform.

The prior art in FIG. 1.0 shows a flatback transom with an outboard motor mounted. This method of attachment utilizes the motor clamp 1. over the flatback transom 2. The outboard motor in FIG. 1.0 is attached on shore by placing the motor clamp over the flatback transom and tightening the motor clamping fasteners. In FIG. 1.1 a stationary or retractable bracket 3. can be attached to the flatback transom, with a motor attached to the bracket mount. It can be seen from FIG. 1.1 that installation of the outboard motor bracket 3. must first be mechanically bolted to the flatback transom on shore. Then the outboard motor is mounted on shore to the retractable bracket 3. The retractable bracket allows for the lowering, raising and trimming of the outboard motor.

The prior art stationary and retractable brackets can only be used on flatback transom configurations. The limiting factor in the flatback stationary or retractable brackets is their interface requires a flatback surface area therefore, it is not mechanically compatible with a transom platform sterndrive configuration as seen in FIG. 2.0. Also, flatback stationary or retractable brackets have a fixed mechanical bolted structural interface and there design does not have the capability for the safe mounting or removal of the bracket and a motor from within the boat. Using these type brackets, the safe and physical installation of the bracket and mounting of an outboard must be accomplished on shore.

The prior art methods of motor mounting described above have inherent interface and user limitations in their configurations that prevents their use with transom platform sterndrives.

It can be seen from FIG. 2.1, that when the sterndrive 4. is mounted under the transom platform 5., there isn't any accessible flatback transom surface area for the attachment of either a stationary or retractable bracket. A rotating configured bracket mount 6. for a transom platform sterndrive semi elliptical cross section is required.

The requirements for a rotating configured bracket mount 6. for use on a transom platform sterndrive are as follows: The bracket must be configured for a mechanically compatible attachment to a transom platform sterndrive and provide for ease of mounting and removal of the bracket and motor from within the boat. The bracket provides a mount, for mounting of an emergency outboard motor backup source of power.

This invention as seen in FIG. 2.2 is a rotating bracket that is mechanically compatible with a transom platform sterndrive. It provides for the safe within the boat and physically possible installation of a backup bracket mount 14. and outboard motor when needed.

SUMMARY OF THE INVENTION

This invention FIG. 2.1 is a rotating configured bracket mount 6. that satisfies all the requirements of interfacing with a transom platform sterndrive boat. It can structurally carry the outboard motor static and dynamic loads while providing for a safe on board bracket and motor installation. The motor and bracket are removable from on board for an on board storage when not needed. This invention when used on a transom platform sterndrive boat and provides a reliable emergency bracket and motor backup power source. This invention facilitates the mounting of an outboard motor on a sterndrive boat by allowing the FIG. 2.2 motor mount 14. to pivot upward. The motor mount travels inboard and is locked in place with a support rod 8. The motor mount 14. is now in the horizontal inboard position allowing for the safe on board mounting of the outboard motor and tightening of the motor clamps. This invention is mechanically compatible to transom platforms with FIG. 2.1 semi-elliptical 5. cross section or FIG. 1.3 straight 9. cross section type configurations.

BRIEF DESCRIPTION OF THE DRAWINGS

FIG. 1.0 Flatback transom configuration and typical integral motor clamp - (Prior Art)

FIG. 1.1 Flatback transom configuration with retractable bracket and outboard motor attached (Prior Art)

FIG. 2.0 An assembly drawing of an outboard motor mounted on a boat with a horizontal transom platform and flat or vertical stern configuration.

FIG. 3.0 A perspective view of a horizontal transom platform U Assembly and resilient pads that are installed between the U-tray and the horizontal transom platform.

FIG. 3.1 A perspective view of the motor mount assembly that seats in the shelf U-tray of FIG. 3.0.

FIG. 3.2 A perspective view of struts and links that attach to and support the motor mounting assembly.

FIG. 3.3 A perspective view of the internal, permanently installed structure for added strength to the horizontal transom platform.

FIG. 4.0 Shows an assembly drawing of the outboard motor mounting system installed on a boat with a horizontal transom platform and a semi elliptical stern profile.

FIG. 5.0 Shows a horizontal transom platform with a flat or vertical stern configuration, with the outboard motor retracted and stowed when not in use.

FIG. 6.0 A perspective view of the internal, permanently installed support web structure for a boat with a semi elliptical stern profile, as shown in FIG. 4.0.

DESCRIPTION OF THE PREFERRED EMBODIMENTS OF THE INVENTION

This invention, a rotating bracket mount for a built in transom platform sterndrive configured boat, provides the safe on board mounting and removal for storage, of an emergency back-up outboard motor power source.

In FIG. 3.0, the upper platform shelf tray 10. of the special bracket mount is mounted on the boats transom platform. The upper platform shelf tray assembly is the base and serves to anchor the FIG. 3.1 pivot tray assembly 11. The upper platform shelf tray 10. is through-bolted to the transom platform with the inside FIG. 4.0 having marine plywood backing plates 15. and 16.

A boat's transom platform is a sandwich composite design of fiberglass/plywood/fiberglass. The transom platform is fiberglass tied to the boat's main stringers and that defines the shelves 5. 'load path'. Referring to the overview of a rotating bracket structure on a sterndrive transom platform FIG. 2.0 and in FIG. 4.0, it can be seen that the Lower Platform Struts 12., Upper Platform Tray 13., the Motor Mount 14., and the backing plates 15. and 16. with the internal plywood 'webs' 17. attached, serve as a boxed structure for load transfer to the boats main stringers. The Pivot Tray 18. as seen in FIG. 2.2 can be pivoted to the vertical position for motor mounting. The FIG. 2.2 Pivot Tray Support Rods 8., safely hold the Pivot Tray in the vertical position for motor mounting while on board. It can then be lowered as seen in FIGS. 2.2 and 1.3 pin locked 19. in place for the outboard motor use. In FIGS. 3.0 and 3.1 all joints are welded 20. The Upper Platform and Pivot Trays have welds with 3/16" throats along all interfaces. In FIG. 4.0 the secure pinning 21. of the Lower Platform Struts 12. to the pivot tray assembly 18. is shown. The through-bolted upper 15. and lower 16. backing plates are shown in FIG. 4.0. The Lower Platform Struts have two rubber snubber pads 22. to allow the angle stainless steel to conform to the under side of the transom platform fiberglass irregularities, and also reduce any outboard motor vibrations and shock. The through bolted backing plates provide stiffening. All 'through holes' are impregnated with silicon sealant 23. The silicon sealant is applied as a pad to the undersides of both upper 23. and lower 23. plywood through bolted backing plates. The FIG. 4.0 Motor Mount 14., can be adjusted up or down to allow for differences between motors with long shafts ~20", 25" and short shaft ~15". During the transition of the Pivot Tray Structure FIG. 2.2 from vertical 24. positions for motor mounting and back down to monitoring use, the pivot tray is rotated manually. The Pivot Tray Structure can be aided using one of the following devises a motorized gear set, a gear crank, or a torsional coil spring mounted on the Pivot Tray rod and anchored to Upper Platform Shelf Tray Assembly.

What is claimed is:

1. An outboard mounting system for attaching, supporting and operating an outboard motor on a horizontal platform of stern drive boats, comprising:

a structure permanently attached to the boat comprising a support element, a strut having a link extending thereon and having an aperture, a platform tray having a plurality of apertures, and a rotating bracket having a plurality of apertures and being pivotally secured to said platform tray; and a motor mount mounted to said rotating bracket for securely receiving said outboard motor, the motor mount further comprising an aperture; wherein when the outboard motor is in an operating position the motor mount is secured to the permanently attached structure by inserting a bolt through the link and the motor mount apertures, and when the outboard is in its non operating position, the rotating bracket pivots with respect to the platform tray, elevating the outboard motor above the boat, and secured therein with a rod positioned between the tray platform and the pivoting bracket.

2. The motor mounting system of claim 1, wherein said motor mount rotates about pivot pins from said operating and non-operating positions.

* * * * *